US010798981B2

(12) United States Patent
Toba

(10) Patent No.: US 10,798,981 B2
(45) Date of Patent: Oct. 13, 2020

(54) WIG BASE AND WIG

(71) Applicant: Aderans Company Limited, Tokyo (JP)

(72) Inventor: Mayumi Toba, Tokyo (JP)

(73) Assignee: ADERANS COMPANY LIMITED, Tokyo (JP)

( * ) Notice: Subject to any disclaimer, the term of this patent is extended or adjusted under 35 U.S.C. 154(b) by 234 days.

(21) Appl. No.: 15/570,902

(22) PCT Filed: Apr. 26, 2016

(86) PCT No.: PCT/JP2016/063044
§ 371 (c)(1),
(2) Date: Oct. 31, 2017

(87) PCT Pub. No.: WO2016/178390
PCT Pub. Date: Nov. 10, 2016

(65) Prior Publication Data

US 2018/0289092 A1 Oct. 11, 2018

(30) Foreign Application Priority Data

May 1, 2015 (JP) ..... 2015-094201

(51) Int. Cl.
*A41G 3/00* (2006.01)
*A45D 44/22* (2006.01)

(52) U.S. Cl.
CPC ..... *A41G 3/0033* (2013.01); *A41G 3/005* (2013.01); *A45D 44/22* (2013.01); *A41G 3/0016* (2013.01); *A41G 3/0066* (2013.01)

(58) Field of Classification Search
CPC .... A41G 3/0016; A41G 3/0041; A41G 3/005; A41G 3/0058; A41G 3/0066; A45D 44/22
See application file for complete search history.

(56) References Cited

U.S. PATENT DOCUMENTS 3,046,999 A * 7/1962 Lint ..... A41G 3/0016 132/54
3,521,648 A * 7/1970 Capparelli ..... A41G 3/00 132/53

(Continued)

FOREIGN PATENT DOCUMENTS

CN 101431909 5/2009
CN 101505621 8/2009

(Continued)

OTHER PUBLICATIONS

Extended European Search Report dated Oct. 30, 2018 in European Application No. 16789526.7.

(Continued)

*Primary Examiner* — Cris L. Rodriguez
*Assistant Examiner* — Brianne E Kalach
(74) *Attorney, Agent, or Firm* — Wenderoth, Lind & Ponack, L.L.P.

(57) ABSTRACT

There is provided a wig base comprising: a first elastic portion having a first modulus of elasticity, to which artificial hairs will be planted, second elastic portion(s) connected to the first elastic portion, having a second modulus of elasticity that is larger than the first modulus of elasticity, to which artificial hairs will be planted, and a position holding portion which is a member connected to the second elastic portion, and which holds own hairs or a skin of a wearer located at the position of the member, wherein the first elastic portion, the second elastic portion and the positon holding portion are placed in the order thereof from a top of the head while wearing the wig, and wherein the positon holding portion pulls up a skin of the face of a wearer towards a top of the head while wearing the wig.

9 Claims, 4 Drawing Sheets

(56) References Cited

U.S. PATENT DOCUMENTS

| | | | | | |
|---|---|---|---|---|---|
| 3,564,583 | A * | 2/1971 | Klugman | A41G 3/00 | 132/53 |
| 3,835,867 | A * | 9/1974 | Molinario | A41G 3/0016 | 132/201 |
| 4,239,037 | A | 12/1980 | Fausone | | |
| 5,476,478 | A | 12/1995 | Jackson | | |
| 5,555,900 | A * | 9/1996 | Rich | A45D 44/22 | 132/200 |
| 5,988,177 | A * | 11/1999 | Bate | A41G 3/005 | 132/54 |
| 6,971,397 | B1 | 12/2005 | Knight | | |
| 2006/0144413 | A1 | 7/2006 | Yoneda et al. | | |
| 2007/0261708 | A1 | 11/2007 | Makino et al. | | |
| 2009/0133710 | A1 | 5/2009 | Wee | | |
| 2010/0192965 | A1 * | 8/2010 | Kang | A41G 3/0041 | 132/54 |
| 2010/0236563 | A1 | 9/2010 | Kimura et al. | | |

FOREIGN PATENT DOCUMENTS

| | | | | |
|---|---|---|---|---|
| GB | 2095549 | * | 10/1982 | A41G 3/00 |
| JP | 2000-096327 | | 4/2000 | |
| JP | 2000-328336 | | 11/2000 | |
| JP | 2001-81618 | | 3/2001 | |
| JP | 2008-57078 | | 3/2008 | |
| JP | 2008-63696 | | 3/2008 | |
| JP | 4256873 | | 2/2009 | |
| JP | 3163106 | | 9/2010 | |
| JP | 3163240 | | 9/2010 | |
| JP | 5016328 | | 6/2012 | |
| JP | 5449609 | | 1/2014 | |
| JP | 5534859 | | 5/2014 | |
| JP | 2014-117308 | | 6/2014 | |
| JP | 3193121 | | 8/2014 | |
| TW | I276405 | | 3/2007 | |
| TW | M495742 | | 2/2015 | |
| WO | 2012/009370 | | 1/2012 | |

OTHER PUBLICATIONS

International Search Report dated Aug. 9, 2016 in International (PCT) Application No. PCT/JP2016/063044.

* cited by examiner (a)

(b)

WIG BASE AND WIG

FIELD OF INVENTION

The present invention relates to a wig base and a wig to which artificial hairs are planted.

DESCRIPTION OF RELATED ART

The wig formed by planting artificial hairs formed by natural hairs or manmade hairs composed of synthetic fibers to a wig base has come into wide use. Currently, a case that a woman uses the wig is increasing. In this case, if hairs appear young due to the wig, it is possible that sags of a skin of the face become eye-catching, and thereby causing unnatural appearance.

In order to cope with this problem, there is proposed a flexible body attached to a cap net of the wig, which has a comb shaped fixing tool for clamping own hairs located at the temple portion of a wearer (for example, refer to Patent Document 1). Further, there is also proposed a wig having a wig base in which front and rear non-flexible nets are connected by a rubber or the like which has flexibility (for example, refer to Patent Document 2).

Patent Document 1: JPU3163240

Patent Document 2: JP5449609B

SUMMARY OF INVENTION

Problem to be Solved

A skin of the face may be pulled up by the flexible body described in Patent Document 1. However, since the flexible body is connected to the cap net, handling for attaching the wig to the head becomes complicated and there is a risk to cause disfigurement while wearing the wig. Further, since the flexible body is formed by a single rubber, if modulus of elasticity of the rubber is high, a wearer feels pain by pulling a skin strongly, and on the contrary, if modulus of elasticity of the rubber is low, a skin may not be pulled up sufficiently, and it causes a problem that the flexible body does not have an enough function to reduce sags or wrinkles of a skin of the face.

In the wig described in Patent Document 2, a skin of the face may be pulled up by the rubber or the like. However, since a function to expand and contract is made by a single rubber or the like, without a special means to engage a wig with a skin of the face, it may not pull up a skin of the face sufficiently, especially, a skin around the temple or the tail of eye, and therefore, there is a problem that it does not have an enough function to reduce sags or wrinkles of a skin of the face.

An object of the present invention is to solve the above-mentioned problems, and to provide a wig base and a wig, which may be handled easily when attached to the head, which have an enough function to reduce sags or wrinkles of a skin of the face, and which has an excellent appearance.

Means for Solving Problems

In order to solve the above-mentioned problem, a wig base according to one aspect of the present invention comprises:

a first elastic portion having a first modulus of elasticity, to which artificial hairs are planted, second elastic portion(s) connected to the first elastic portion, having a second modulus of elasticity that differs from the first modulus of elasticity, to which artificial hairs are planted, and a position holding portion connected to the second elastic portion, for holding a skin of the face of a wearer, wherein the first elastic portion, the second elastic portion and the positon holding portion are placed in the order thereof from a top of the head while wearing the wig.

A wig according to one aspect of the present invention is formed by planting artificial hairs to the above-mentioned wig base.

Effect of Invention

According to the above-mentioned aspects of the present invention, it may provide a wig base and a wig, which may be handled easily when attached to the head, which have an enough function to reduce sags or wrinkles of a skin of the face, and which has an excellent appearance.

DESCRIPTION OF EMBODIMENT

Figure 1:
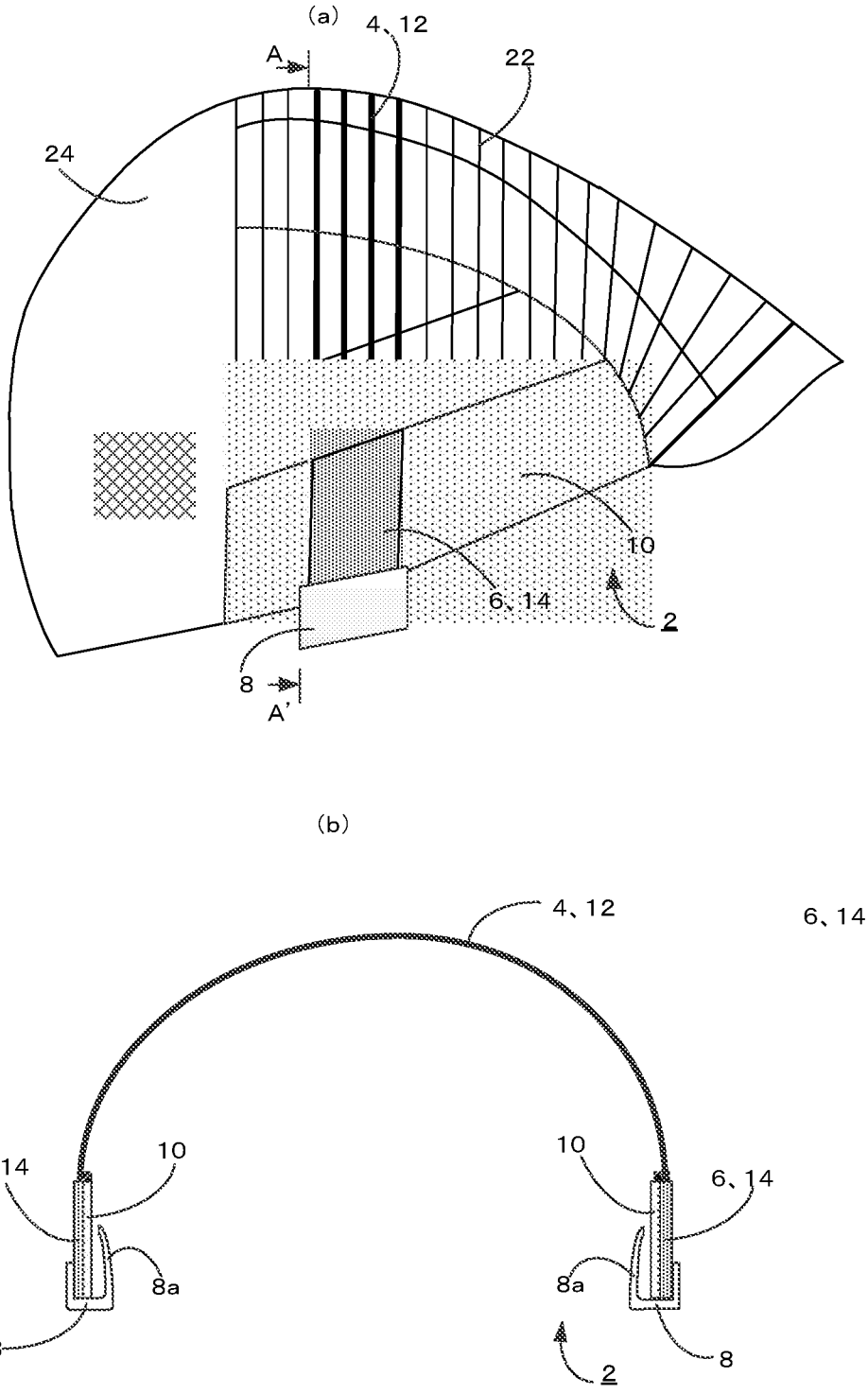
FIG. 1 is a side view and a sectional view for schematically illustrating a construction of a wig according to one embodiment of the present invention.

A wig base according to Aspect 1 of the present invention comprises:

a first elastic portion having a first modulus of elasticity, to which artificial hairs are planted, second elastic portion(s) connected to the first elastic portion, having a second modulus of elasticity that differs from the first modulus of elasticity, to which artificial hairs are planted, and a position holding portion connected to the second elastic portion, for holding a skin of the face of a wearer, wherein the first elastic portion, the second elastic portion and the positon holding portion are placed in the order thereof from a top of the head while wearing the wig.

It is possible that the first elastic portion and the second elastic portion are placed at all of the periphery direction, and placed at a part of the periphery direction (for example, both side of the head) while wearing the wig. Relating to modulus of elasticity of the first elastic portion and the second elastic portion, either of them may be larger.

In the following description, when a wig base (or wig) is attached to the head of a wearer and a position of the wig base (wig) is adjusted and finally set, it is called "when attached to the head." While a wearer wears the wig after setting the wig base (wig), it is called "while wearing the wig".

According to this Aspect, since a sufficient flexibility and a sufficient elasticity may be obtained by connecting elastic portions having different modulus of elasticity, it has a function to reduce sags or wrinkles of a skin of the face as well as a wearer may use the wig base comfortably. Further, since the position holding portion is connected to the elastic portion having a sufficient elasticity, it may easily handle the position holding portion for holding a skin of the face, and the wig itself has a function to reduce sags or wrinkles, it may be handled easily when attached to the head. Further, since artificial hairs are also planted to the elastic portion, it is possible to achieve the wig base which may provide an excellent appearance.

In the wig base according to Aspect 2 of the present invention, according to the above-mentioned Aspect 1, modulus of elasticity of the second elastic portion is larger than that of the first elastic portion.

In this Aspect, since modulus of elasticity of the second elastic portion which is positioned lower than the first elastic portion while wearing the wig, and also connected to the position holding portion is larger than of the first elastic portion, a skin of the face may always be effectively pulled up after the wig is attached to the head.

In the wig base according to Aspect 3 of the present invention, according to the above-mentioned Aspect 1 or 2, the second elastic portions which have a belt-like shape as a total are connected to the first elastic portion which has a belt-like shape as a total at both ends of the first elastic portion, and the first elastic portion is positioned at a top of the head and both side of the head, and the second elastic portions are positioned at both sides of the head while wearing the wig.

In this Aspect, since the elastic portion is positioned at the both side of the head while wearing the wig, for example, it may pull up a skin located in front of the ear, around the temple, and thereby efficiently reducing wrinkles of the tail of eye and sags of the cheek or the like.

In the wig base according to Aspect 4 of the present invention, according to the above-mentioned Aspect 3, the first elastic portion is formed by a plurality of members composed of elastic fibers having a belt-like shape or a string shape.

As the "elastic fibers", not only polyurethane or polyester but also nylon, acrylic, acetate, wool or the like may be exemplified. However, it is not limited thereto. As the member composed of elastic fibers having a belt-like shape or a string shape, a knitted work or a textile may be exemplified, and a mesh-like item having a space into which artificial hairs are inserted may also be utilized.

The first elastic portion according to this embodiment is formed in a belt-like shape as a total by the plurality of members having a belt-like shape or a string shape.

In this embodiment, since the first elastic portion is formed by the plurality of members composed of elastic fibers having a belt-like shape or a string shape, it has a sufficient flexibility and a sufficient elastic force.

In the wig base according to Aspect 5 of the present invention, according to the above-mentioned Aspect 3 or 4, the second elastic portion is formed by an elastic member having a belt-like shape.

The "elastic member having a belt-like shape" is an elongated sheet-like member having elasticity. It may be a knitted work or a textile formed by elastic fibers, or a molded item formed by an elastic resin material. Further, a mesh-like item having a space into which artificial hairs are inserted may also be utilized.

In this Aspect, since the second elastic portion is formed by the elastic member having a belt-like shape, it has a sufficient flexibility and a sufficient elastic force.

In the wig base according to Aspect 6 of the present invention, according to any one of the above-mentioned Aspect 1 to 5, the position holding portion includes an engaging member which engages with a wig substrate net or own hairs of a wearer.

In this Aspect, a skin of the face of a wearer may surely be held by the position holding portion, by engaging with the wig substrate net which contacts a skin of a wearer, or own hairs themselves.

In the wig base according to Aspect 7 of the present invention, according to any one of the above-mentioned Aspect 1 to 6, the wig base further includes a periphery direction elastic portion which expands and contracts in the periphery direction of the head while wearing the wig.

In this Aspect, a wig may surely be attached to the head of a wearer by the periphery direction elastic portion which expands and contracts in the periphery direction of the head. Further, it may also perform the function of the position holding portion by holding a skin of the face of a wearer by the periphery direction elastic portion.

In the wig base according to Aspect 8 of the present invention, according to Aspect 7, artificial hairs may be planted to the periphery direction elastic portion.

In this Aspect, since artificial hairs may be planted to the periphery direction elastic portion, a wig having an excellent appearance may be provided.

In a wig base according to Aspect 9 of the present invention, the wig is formed by planting artificial hairs to the wig base according to any one of Aspect 1 to 8.

In this Aspect, it may provide a wig which may be handled easily when attached to the head, which have an enough function to reduce sags or wrinkles of a skin of the face, and which has an excellent appearance.

Next, with referring to the attached drawings, a wig according to the above-mentioned Aspects will be described in detail.

(Description of Construction of Wig Base according to One Embodiment)

Firstly, with referring to FIG. 1, a wig base according to one embodiment of the present invention is described. FIG. 1(*a*) is a side view for schematically illustrating a construction of a wig according to one embodiment of the present invention, and FIG. 1(*b*) is a sectional view seen from the arrow A-A of FIG. 1(*a*).

In FIG. 1, a wig base 2 according to this embodiment includes a first elastic portion 4 having a first modulus of elasticity, to which artificial hairs may be planted (shown in four vertical bold lines in FIG. 1(*a*)), second elastic portion (s) 6 connected to the first elastic portion 4, having a second modulus of elasticity that is different from that the first modulus of elasticity, to which artificial hairs may be planted, and a position holding portion 8 connected to the second elastic portion 6, for holding a skin of the face of a wearer. While wearing the wig in which artificial hairs are planted to the wig base 2, the first elastic portion 4, the second elastic portion 6 and the positon holding portion 8 are placed in the order thereof from a top of the head. In the following description, it is described using positions while wearing the wig (for example, upper side, lower side, front side, rear side).

In the wig base 2 according to this embodiment, modulus of elasticity of the second elastic portion 6 which is positioned lower than the first elastic portion is larger than that of the first elastic portion 4 which is positioned at a top of the head side.

As illustrated in the side view of FIG. 1(*a*), in the wig base 2 according to this embodiment, the second elastic portions 6 which have a belt-like shape as a total are connected to the first elastic portion 4 which has a belt-like shape as a total at both ends of the first elastic portion 4 (only one side is shown in FIG. 1(*a*)). While wearing the wig, the first elastic portion 4 is positioned at a top of the head and both sides of the head, and the second elastic portions 6 are positioned at both sides of the head. Further, while wearing the wig, the wig base 2 includes a periphery direction elastic portion 10 which expands and contracts in the periphery direction of the head.

In the side view of FIG. 1(*a*), a mesh portion 22 formed by a string shaped member to which artificial hairs may be planted are placed at the front and the rear sides of the first elastic portion 4 which have a belt-like shape as a total. A surface portion 24 formed by a sheet-like member to which artificial hairs may be planted are placed at further front side. Relating to the string shaped member forming the mesh portion 22 to which artificial hairs may be planted or the sheet-like member forming the surface portion 24 to which artificial hairs may be planted, a mesh-like item having a space into which artificial hairs are inserted may be utilized. Relating to modes of planting artificial hairs to the first elastic portion 4, the second elastic portion 6, the mesh portion 22 and the surface portion 24 will be described in detail later.

The embodiment as illustrated in FIG. 1 is only one example. For example, it is possible that all the part except the first elastic portion 4 and the second elastic portion 6 is formed by the mesh portion 22, and on the contrary, it is also possible that all the part except the first elastic portion 4 and the second elastic portion 6 is formed by the surface portion 24. Any ratio of the mesh portion 22 and the surface portion 24 may be arranged at any position according to applications.

Relating to the first elastic portion 4, in detail, it is formed by four members 12 composed of elastic fibers having a belt-like shape. If width of the belt-like shaped member 12 is narrow, it may be called a "string shaped member". Therefore, it is hereinafter called "the member 12 composed of elastic fibers having a belt-like shape or a string shape".

As the "elastic fibers", not only polyurethane or polyester but also nylon, acrylic, acetate, wool or the like may be exemplified. However, it is not limited thereto. As the member 12 composed of elastic fibers having a belt-like shape or a string shape, a knitted work or a textile composed of elastic fibers may be exemplified, and a mesh-like item having a space into which artificial hairs are inserted may also be utilized.

Further, the number of the member 12 composed of elastic fibers having a belt-like shape or a string shape, which forms the first elastic portion 4 is not limited to four. Any number of the member 12 composed of elastic fibers having a belt-like shape or a string shape may be utilized according to required dimension, required modulus of elasticity, a kind of elastic fibers or the like. The first elastic portion 4 according to this embodiment is configured to have a belt-like shape as a total by the plurality of members 12 composed of elastic fibers having a belt-like shape or a string shape.

As mentioned above, in this embodiment, since the first elastic portion 4 is formed by the plurality of members composed of elastic fibers having a belt-like shape or a string shape, it has a sufficient flexibility and a sufficient elasticity.

The second elastic portion 6 is described in detail. The second elastic portion 6 is formed by a belt-like member 14 having elasticity. The belt-like member 14 having elasticity is an elongated sheet-like member having elasticity, and it may be a knitted work or a textile formed by elastic fibers, or a molded item formed by an elastic resin material. Further, a mesh-like item having a space into which artificial hairs are inserted may also be utilized.

As mentioned above, in this embodiment, since the second elastic portion 6 is formed by the belt-like member having elasticity, it may have a sufficient flexibility and a sufficient elastic force.

Next, modes of planting artificial hairs to the first elastic portion 4, the second elastic portion 6, the mesh portion 22 and the surface portion 24 is described in detail. Artificial hairs may be planted by inserting artificial hairs into an opening of the mesh of the net, tying the artificial hairs to a frame member (filament) of the mesh. Thus, artificial hairs may be planted by winding the artificial hairs around a frame member (filament) of the mesh, then tying and fixing them. While more detailed explanation about tying method of artificial hairs is omitted, any known tying method of artificial hairs may be utilized.

Artificial hairs may be planted not only by tying the artificial hairs but also by adhering artificial hairs by using coating agents to a sheet shaped member such as an artificial skin made of resin or the member composed of a resin material having a belt-like shape or a string shape. In this embodiment, any other known planting method of artificial hairs may be applied. There are cases that one artificial hair is planted to one planting place, and that two or more hairs are planted to one planting place.

Next, the position holding portion 8 is described in detail. As illustrated in FIG. 1(*b*), the position holding portion 8 according to this embodiment includes an engaging member 8*a* which engages with a wig substrate net or own hairs of a wearer. Further in more detail, as illustrated in FIG. 1(*b*), the engaging member 8*a* has a claw portion having elasticity, and it may engage by clamping a lower edge of the wig substrate net or the own hairs of a wearer using the claw portion.

Figure 2:
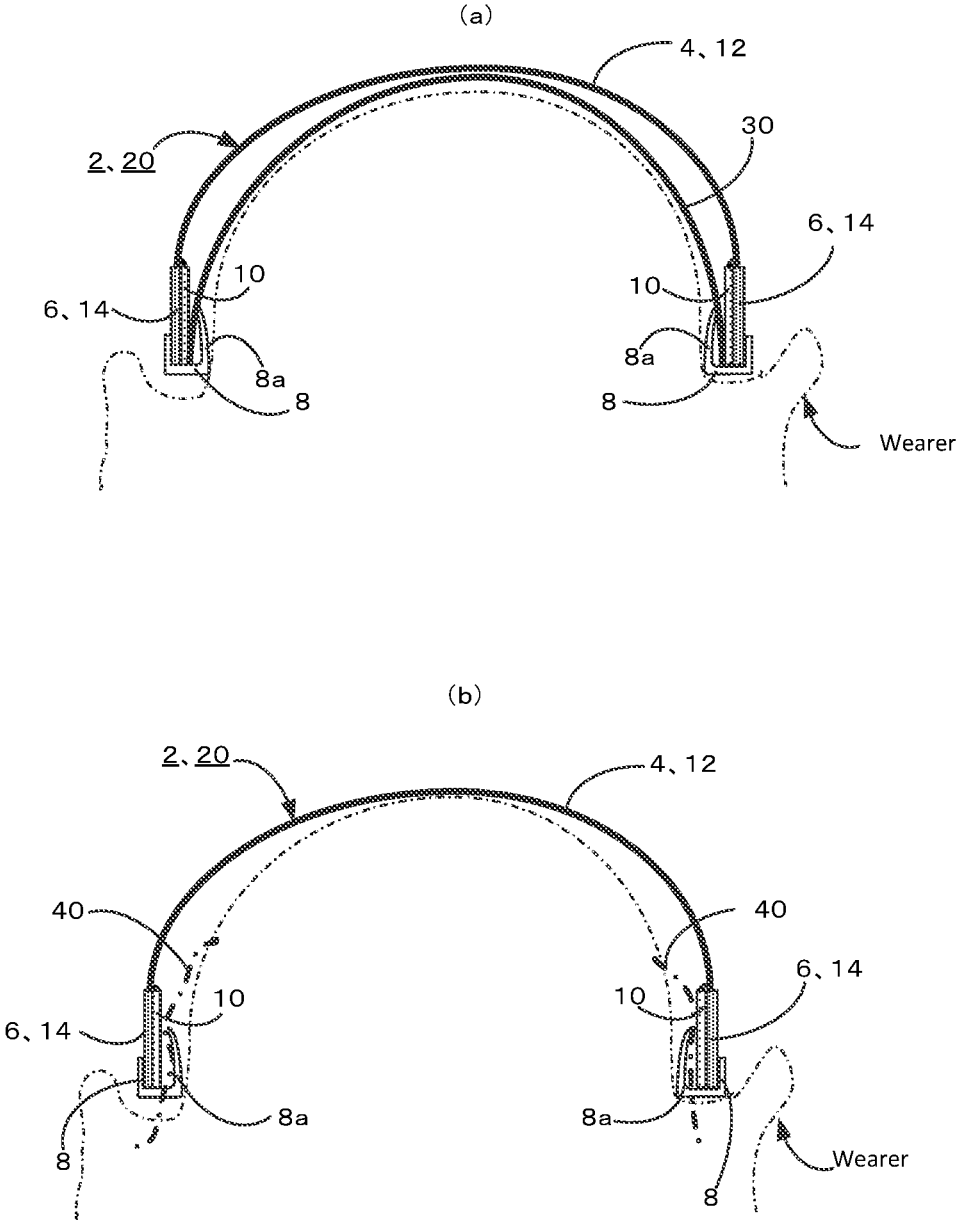
FIG. 2 is a sectional view for schematically illustrating a mode when the wig according to one embodiment of the present invention is attached to the head.

One example of the state of wearing the wig 20 according to this embodiment to which artificial hairs are planted to the wig base 2 is illustrated in FIG. 2. In FIG. 2, while in order to show each member clearly, it is illustrated such as having a clearance among the wig base 2 (wig 20), the wig substrate net 30 and the head of a wearer, they are actually contact together in many places.

FIG. 2(*a*) illustrates a case that a wearer uses the wig substrate net 30, such as clamping the lower edge of the wig substrate net 30 by the claw portion of the engaging member 8*a* of the position holding portion 8.

In this case, the lower edge of the wig substrate net 30 and a skin of a wearer are fixed by the elastic member provided at the lower edge of the wig substrate net 30. Therefore, when the engaging member 8*a* of the position holding portion 8 and the lower edge of the wig substrate net 30 are engaged with each other, a skin of the face of a wearer may be held by the position holding portion 8. Accordingly, a skin may be pulled up and sags or wrinkles of a skin of the face may be reduced by an elastic force between the first elastic portion 4 and the second elastic portion 6, especially, an elastic force of the second elastic portion 6 placed at a lower position having larger modulus of elasticity.

FIG. 2(*b*) illustrates a case of clamping own hairs 40 of a wearer by the claw portion of the engaging member 8*a* of the position holding portion 8. While the wig substrate net 30 is not illustrated in FIG. 2(*b*), it is also possible to engage by clamping own hairs 40 of a wearer by the claw portion of the engaging member 8*a* of the position holding portion 8 while a wearer wears the wig substrate net 30. Since the position holding portions 8 are positioned around the position of ears at both sides of the head, for example, a skin of the face of a wearer may be held with the engagement by clamping own hairs 40 of a wearer in front of the ear by the claw portion of the engaging member 8*a* of the position holding portion 8. Accordingly, being similar to the case of FIG. 2(*a*), a skin may be pulled up and sags or wrinkles of a skin of the face may be reduced by an elastic force between the first elastic portion 4 and the second elastic portion 6, especially, an elastic force of the second elastic portion 6 placed at a lower position having larger modulus of elasticity.

Especially, in this embodiment, a skin of the face of wearer may surely be held by the position holding portion 8 with engaging with the wig substrate net 30 which closely contacts a skin of a wearer, or engaging with own hairs of wearer themselves.

In the both embodiments of FIGS. 2(*a*) and (*b*), since the first elastic portion 4 and the second elastic portion 6 have elasticity, and especially, the first elastic portion 4 having lower elasticity expands so much. Therefore, when the wig 20 is attached to the head and finally set, a wearer easily pulls down the position holding portion 8, and engages the position holding portion 8 with the lower edge of the wig substrate net 30 or own hairs 40 of a wearer. Thus, it may easily handle the position holding portion 8 for holding a skin of the face.

On the contrary, while wearing the wig after the wig 20 is attached to the head, since the first elastic portion 4 and the second elastic portion 6 contact the head of a wearer or the wig substrate net 30, the position may be maintained by static friction. Especially, the first elastic portion 4 contacts both a top and both sides of the head, it has a large effect for maintaining the position by static friction.

Accordingly, when the wig 20 is attached to the head and set, the first elastic portion 4 having lower elasticity expands so much that the position holding portion 8 may easily engage with the lower edge of the wig substrate net 30 or own hairs 40 of a wearer, and further after setting of the wig 20, the position of the first elastic portion 4 is maintained stably.

Accordingly, a skin of the face held by the position holding portion 8 is pulled up especially by the second elastic portion 6 which is positioned at lower position and directly connected to the position holding portion 8. Further, since modulus of elasticity of the second elastic portion 6 is larger than that of the first elastic portion 4, a skin of the face is pulled up efficiently by the higher elastic force.

As mentioned above, while wearing the wig after the wig 20 is attached to the head, the elastic portions 4, 6, especially, the position of the first elastic portion 4 which contacts a top and both side of the head of a wearer is maintained by static friction. When a skin or the like of the face moves in a large manner, the upper first elastic portion 4 having a high stretch ability expands against static friction, and thereby lowering a risk to add a pain or a discomfort to a wearer.

As mentioned above, in this embodiment, since a sufficient flexibility and a sufficient elasticity may be obtained by connecting the first elastic portion 4 and the second elastic portion 6 which have different modulus of elasticity, it has an enough function to reduce sags or wrinkles of a skin of the face as well as a wearer may use the wig comfortably. Further, the position holding portion 8 is connected to the first elastic portion 4 and the second elastic portion 6 which have a sufficient flexibility, the position holding portion 8 for holding a skin of the face may be handled easily. Since the wig 20 itself has an enough function to reduce sags or wrinkles of a skin of the face, it may be handled easily when attached to the head. Further, since artificial hairs are planted to the first elastic portion 4 and the second elastic portion 6, the wig 20 and the wig base 2 which have an excellent appearance may be obtained.

Especially, in this embodiment, since modulus of elasticity of the second elastic portion 6 which positioned at a lower side while wearing the wig, and which is directly connected to the position holding portion 8 is larger than that of the first elastic portion 4, a skin of the face may always be pulled up efficiently after the wig 20 is attached to the head.

Further, in this embodiment, the elastic portions 4, 6, especially, the second elastic portions 6 are positioned at both sides of the head, for example, a skin located in front of the ear, around the temple may sufficiently be pulled up, and thereby reducing wrinkles of the tail of eye and sags of the cheek or the like efficiently.

As mentioned above, the wig base 2 according to this embodiment includes the periphery direction elastic portion 10 which expands and contracts in the periphery direction of the head. The periphery direction elastic portion 10 is positioned at both sides of the head while wearing the wig, and connected to the mesh portion 22 and the surface portion 24 at the front and rear edges thereof. Accordingly, a circular shaped portion surrounding the periphery of the head is formed by the mesh portion 22, the periphery direction elastic portion 10 and the surface portion 24, the head is sufficiently fixed by an elastic force of the periphery direction elastic portion 10. The periphery direction elastic portion 10 is connected to the edges of the first elastic portion 4 and the second elastic portion 6 by sawing.

It is possible to provide a length adjusting means at a certain positon of the circular shaped portion formed by the mesh portion 22, the periphery direction elastic portion 10 and the surface portion 24, and thereby adjusting the length of the circular shaped portion according to the size of the head of a wearer.

Further, artificial hairs may be planted to the periphery direction elastic portion 10. As the periphery direction elastic portion 10, a knitted work or a textile formed by elastic fibers composed of polyurethane, polyester, nylon or the like is exemplified. However, it is not limited thereto, and a molded item composed of an elastic resin material (including rubber, elastomer) may also be applied. For the periphery direction elastic portion 10, if a certain modulus of elasticity may be obtained, a mesh-like item having a space into which artificial hairs are inserted may also be utilized. To be Similar to the above, artificial hairs may be planted by winding the artificial hairs around a frame member (filament) of the mesh and tying and fixing the artificial hairs to the frame member (filament).

As mentioned above, in this embodiment, the wig base 2 (the wig 20) may surely be fixed to the head of a wearer by the periphery direction elastic portion 10 which expands and contracts in the periphery direction of the head.

Further, in this embodiment, since artificial hairs may be planted to the periphery direction elastic portion, the wig base and the wig having an excellent appearance maybe provided.

The periphery direction elastic portion 10 may perform the function of the position holding portion 8 by holding a skin of the face of a wearer. This issue will be described in detail with referring to FIG. 3 and FIG. 4.

(Description of Construction of Wig Base according to Another Embodiment)

Figure 3:
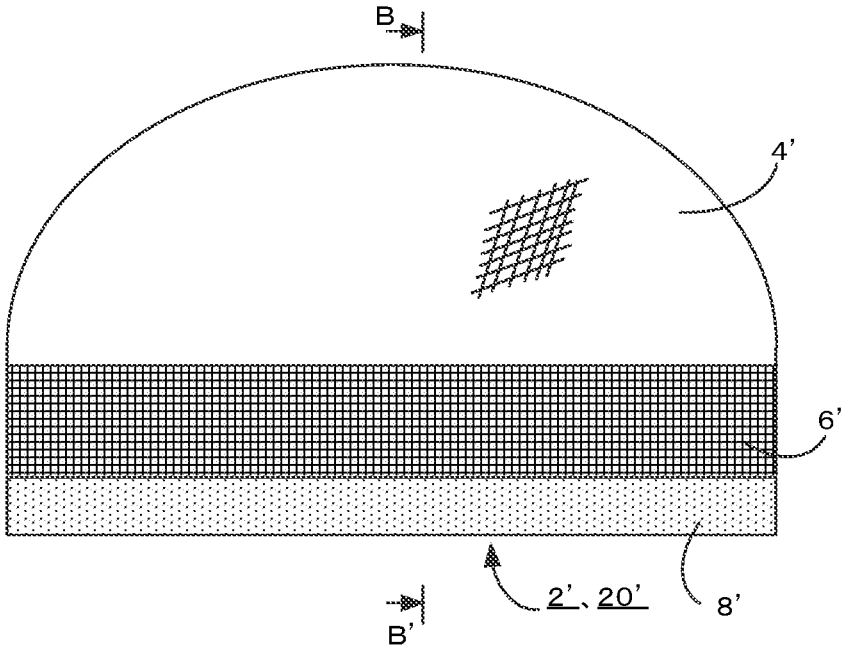
FIG. 3 is a side view and a sectional view for schematically illustrating a construction of a wig according to another embodiment of the present invention.
Figure 3:
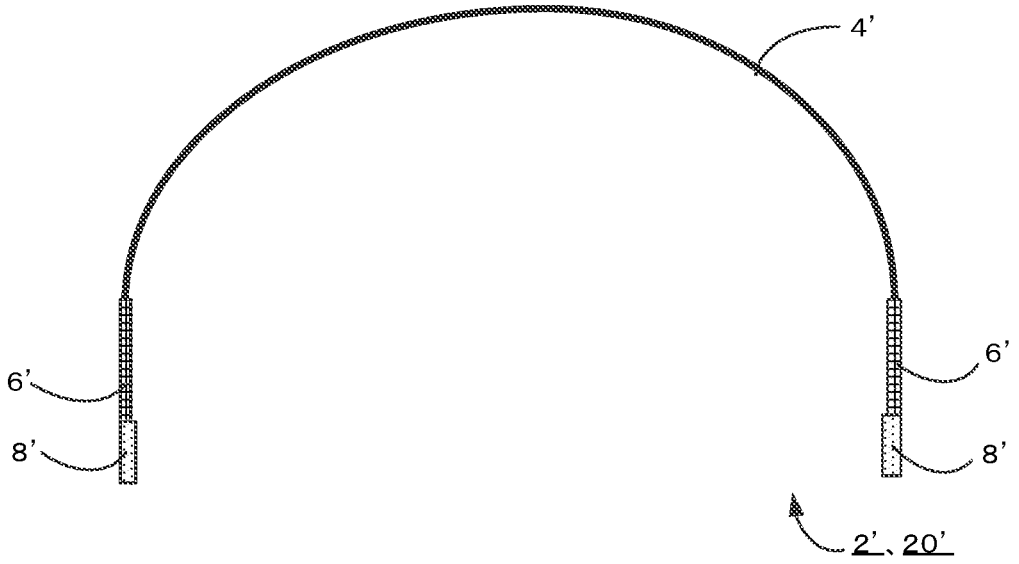

Next, with referring to FIG. 3, a wig base according to another embodiment is described. FIG. 3(*a*) is a side view for schematically illustrating a construction of the wig base according to another embodiment of the present invention. FIG. 3(*b*) is a sectional view seen from the arrow B-B of FIG. 3(*a*).

In FIG. 3, a wig base 2' according to this embodiment includes a first elastic portion 4' having a first modulus of elasticity, to which artificial hairs may be planted, second elastic portion(s) 6' connected to the first elastic portion 4', having a second modulus of elasticity that is different from that the first modulus of elasticity, to which artificial hairs may be planted, and a position holding portion 8' connected to the second elastic portion 6', for holding a skin of the face of a wearer. In this embodiment, the first elastic portion 4' does not have a belt-like shape, and covers all of the top and both sides of the head of a wearer while wearing the wig. The second elastic portion 6' has a circular shape covering a periphery of the head of a wearer while wearing the wig. The position holding portion 8' also has a circular shape covering a periphery of the head of a wearer while wearing the wig. In this embodiment, modulus of elasticity of the second elastic portion 6' which is positioned lower than the first elastic portion 4' is higher than that of the first elastic portion 4' which is positioned at a top of the head.

As a member forming the first elastic portion 4', the second elastic portion 6' and the position holding portion 8', for example, a mesh-like item having a space into which artificial hairs are inserted may also be utilized. Any size of the mesh and pitch may be determined according to required elasticity. Any other material may be utilized including those described above, as far as artificial hairs may be planted thereto and it has a certain modulus of elasticity.

As illustrated in FIG. 3(*b*), the first elastic portion 4', the second elastic portion 6' and the positon holding portion 8' are placed in the order thereof from a top of the head while wearing a wig base 2'. In this embodiment, the position holding portion 8' holds in the periphery direction of the head, and therefore, it has a function of the periphery direction elastic portion. Accordingly, it is not necessary to provide the periphery direction elastic portion separately.

Figure 4:
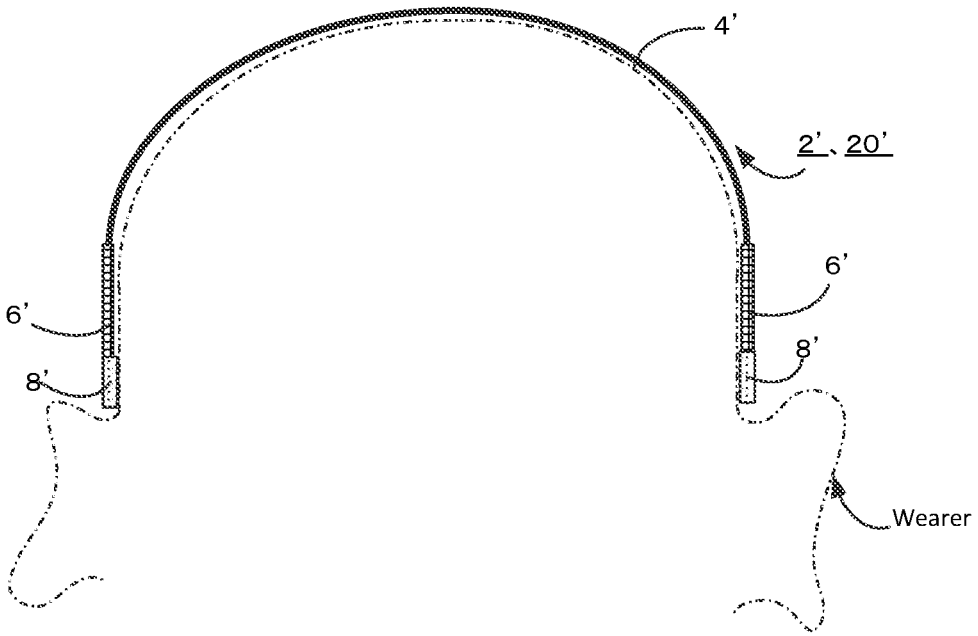
FIG. 4 is a sectional view for schematically illustrating a mode when the wig according to another embodiment of the present invention is attached to the head.

One example of the state of wearing the wig 20' formed by planting artificial hairs to the wig base 2' according to this embodiment is illustrated in FIG. 4. In FIG. 4, while in order to show each member clearly, it is illustrated such as having a clearance among the wig base 2' (wig 20') and the head of a wearer, they are actually contact together in many places.

As illustrated in FIG. 4, a skin of the face of a wearer may surely be held by the position holding portion 8'.

Accordingly, by elastic force of the first elastic portions 4' and the second elastic portions 6', especially, elastic force of the second elastic portions 6' which are positioned at lower position and has a larger modulus of elasticity, a skin may be pulled up, and thereby reducing sags or wrinkles of a skin of the face.

A friction surface may be provided on the surface of the position holding portion 8' which contacts the head. For example, the friction surface may be formed by providing a silicone rubber layer. The friction surface may also be formed by providing a layer composed of a rubber material or an elastomer such as a urethane rubber and a vulcanized rubber. The friction surface may also be formed by forming concavities and convexities on a surface of the positon holding portion 8' which contacts the head surface. Accordingly, a skin of the face may surely be held while wearing the wig.

As mentioned above, in this embodiment, since a sufficient flexibility and a sufficient elasticity may be obtained by connecting the first elastic portion 4' and the second elastic portion 6' which have different modulus of elasticity, it has a function to reduce sags or wrinkles of a skin of the face as well as a wearer uses the wig base comfortably. Especially, in this embodiment, since modulus of elasticity of the second elastic portions 6' which are positioned at lower position while wearing the wig and also directly connected to the position holding portion 8' is larger than modulus of elasticity of the first elastic portion 4', a skin of the face may always be pulled up efficiently while wearing the wig.

Further, in this embodiment, since it may pull up a skin of the face not only at both sides of the head but also a whole periphery direction of the head, it may reduce sags or wrinkles of a skin of all the face.

Further, the wig 20' itself has a function to reduce sags or wrinkles, it may be handled easily when attached to the head. Since artificial hairs are also planted to the first elastic portion 4' and the second elastic portion 6', it is possible to provide the wig 20' and the wig base 2' having an excellent appearance.

Especially, since the position holding portion 8' may be set only by wearing the wig 20' (wig 2'), the position holding portion 8' for holding a skin of the face may be handled easily.

While the present invention has been described according to the embodiments, contents of disclosure of the embodiments may be varied in details of the configuration, and the combination of elements and the change of order in the embodiments may be realized without deviating from the scope of the claims and consciousness of the present invention.

DESCRIPTION OF REFERENCE NUMBERS

2, 2' Wig base
4, 4' First elastic portion
6, 6' Second elastic portion
8, 8' Position holding portion
8*a* Engaging member
12 Members composed of elastic fibers having a belt-like shape or a string shape
14 Belt-like shaped member having elasticity
20 Wig
22 Mesh portion
24 Surface portion
30 Wig substrate net
40 Own hair

What is claimed is:

1. A wig base comprising:

a first elastic portion to which artificial hairs are configured to be planted, the first elastic portion having a first modulus of elasticity;

second elastic portion(s) to which artificial hairs are configured to be planted, the second elastic portion(s) peripherally surrounding the first elastic portion and the second elastic portion(s) having a second modulus of elasticity that is larger than the first modulus of elasticity; and a position holding portion peripherally surrounding the second elastic portion(s), wherein the positon holding portion is configured to pull up skin of the face of a wearer towards a top of the head while wearing the wig.

2. The wig base according to claim 1, wherein the second elastic portions which are substantially elongate in shape and are connected to the first elastic portion at both ends of the first elastic portion, the first elastic portion also being substantially elongate in shape, and wherein the first elastic portion is positioned at a top of the head and both sides of the head, and the second elastic portions are positioned at both sides of the head while wearing the wig.

3. The wig base according to claim 2, wherein the first elastic portion is formed by a plurality of members composed of elastic fibers having a substantially elongate shape or a string shape.

4. The wig base according to claim 1, further comprising at a position of the second elastic portion, a periphery direction elastic portion which expands and contracts in the periphery direction of the head while wearing the wig.

5. The wig base according to claim 4, wherein artificial hairs are configured to be planted to the periphery direction elastic portion.

6. A wig configured to be formed by planting artificial hairs to the wig base according to claim 1.

7. The wig base according to claim 1, wherein the position holding portion includes an engaging member configured to engage with a wig substrate net or own hairs of a wearer.

8. The wig base according to claim 7, wherein the engaging member comprises a claw portion which clamps a lower edge of the wig substrate net to the second elastic portion(s).

9. The wig base according to claim 7, wherein the engaging member comprises a claw portion which clamps the own hairs of the wearer to the wig base such that the own hairs of the wearer are held between an elastic arm of the claw portion and the wig base.

* * * * *